US005683226A

United States Patent [19]

Clark et al.

[11] Patent Number: 5,683,226

[45] Date of Patent: Nov. 4, 1997

[54] STEAM TURBINE COMPONENTS WITH DIFFERENTIALLY COATED SURFACES

[76] Inventors: Eugene V. Clark; Ralph J. Ortolano, both of 7327 Elmo St., Tujunga, Calif. 91042

[21] Appl. No.: 649,249

[22] Filed: May 17, 1996

[51] Int. Cl.[6] ..... F04D 29/44

[52] U.S. Cl. ..... 415/200; 416/241 R

[58] Field of Search ..... 415/200; 416/241 R

[56] References Cited

U.S. PATENT DOCUMENTS

| | | | |
|---|---|---|---|
| 4,492,522 | 1/1985 | Rossmann et al. | 415/200 |
| 4,776,765 | 10/1988 | Sumner et al. | 416/241 R |
| 5,348,446 | 9/1994 | Lee et al. | 416/241 R |
| 5,551,840 | 9/1996 | Benoit et al. | 416/241 R |
| 5,591,009 | 1/1997 | Mannava et al. | 416/241 R |
| 5,601,410 | 2/1997 | Quinlan | 416/241 R |

*Primary Examiner*—John T. Kwon
*Attorney, Agent, or Firm*—Louis J. Bachand

[57] ABSTRACT

Steam turbine fluid directing components are improved in erosive wear resistance by application of either relatively tougher and relatively less hard thermal spray or relatively harder and relatively less tough diffusion alloy surface modification to different portions of the component as a function of the locally greater or locally smaller angle of attack of solid particles on those portions in the use condition of the component.

21 Claims, 1 Drawing Sheet

FIG. 1
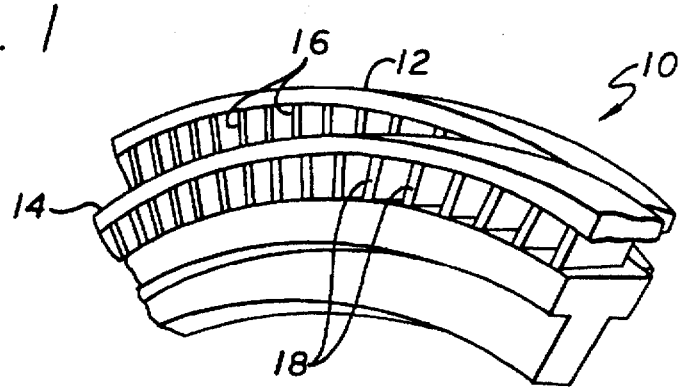
FIG. 2
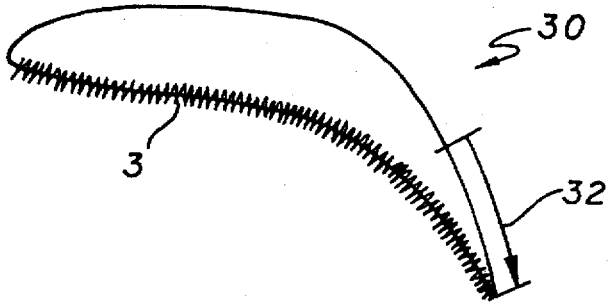
FIG. 3
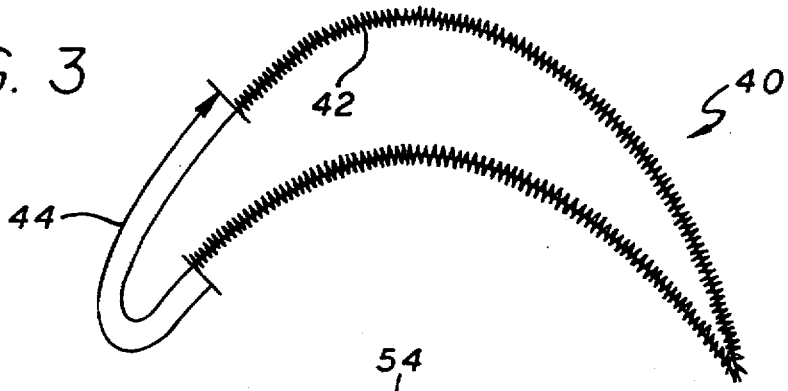
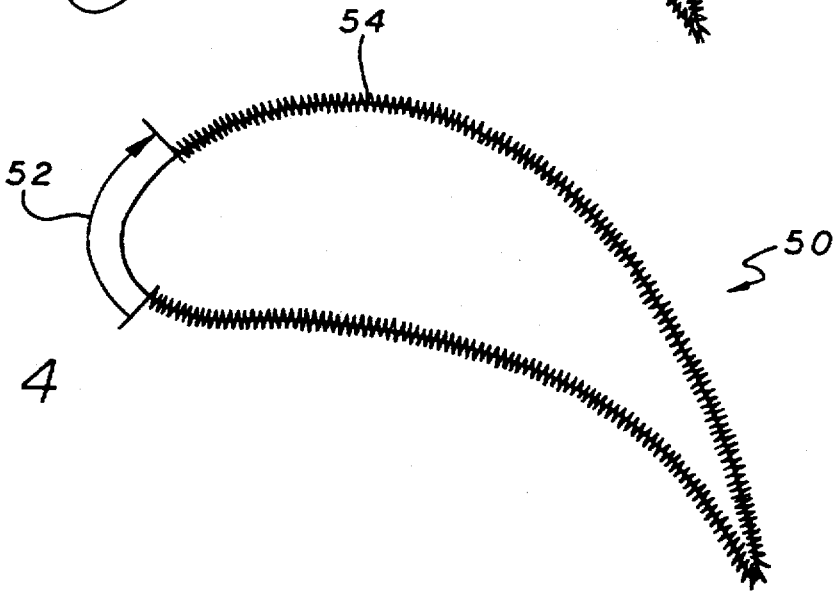
FIG. 4

STEAM TURBINE COMPONENTS WITH DIFFERENTIALLY COATED SURFACES

TECHNICAL FIELD

This application relates to steam turbines and, more particularly, to fluid directing components of steam turbines, including such elements as control stage and reheat stage nozzle partitions, and control stage, reheat stage impulse, and reheat stage reactor rotor blades. Solid particle erosion of these components decreases efficiency of turbines and may ultimately prematurely require costly tear-downs of turbine units and refurbishing of the partitions and blades. Extension of partition and blade life is largely dependent on decreasing erosive wear.

BACKGROUND OF THE INVENTION

Solid particle erosion primarily affects the control and reheat stages of steam turbines and typically is most severe at high inlet pressures (1800 psig and above) and high temperatures (1000° F. and above). Coatings have been introduced to increase the life of the nozzle partitions and rotor blades in these stages, but wear continues in different patterns depending on the application and the coating interdependently.

SUMMARY OF THE INVENTION

A coating may be successful in one area of a component and less successful in limiting wear in a different portion of the component. It is an object therefore to provide turbine components with improved erosion wear resistance over the entire component. It is another object to provide coatings on turbine components tailored to the application and to the wear conditions expected, generally as a function of angle of attack of the erosive stream, which attack angle is determined by the type and configuration of the component, and its placement in the turbine. A further object is to vary the coating on a single component by both placement and composition to more effectively counter different wear conditions. With the present invention, control and reheat stage rotor blades and vanes show dramatic improvements in wear performance as the coating type is tailored to the wear type in a single component, taking into account the component location in the turbine. For example, harder coatings are used on certain surfaces of control stage nozzles and rotor blades, and tougher coatings on other surfaces thereof. It is a further object to use the tougher thermal spray coatings on certain surface regions where they are most effective, such as where the erosive stream of solid particles attacks the surface region at an angle of 30 degrees or more, and to use the harder diffusion alloy coating, or surface modification, where the stream of erosive solid particles attacks the surface region at an angle of 20 degrees or less.

These and other objects of the invention to become apparent hereinafter are realized with the method of erosion protecting a steam turbine component having plural fluid directing surface regions spaced apart and differently subject to solid particle impacts at angles ranging from below 20 degrees to above 30 degrees to the component surface as a reference plane, which includes interposing a first surface protection comprising a thermal spray surface coating on component surface regions where solid particle impacts are at angles above 30 degrees to the component surface, and interposing a second surface protection comprising a diffusion alloy surface modification on other component surface regions where solid particle impacts are at angles below 20 degrees to the component surface, whereby the component is differently protected in different surface regions thereof as a function of the angle of attack of solid particles.

In this and like embodiments, the method further includes spraying a refractory metal carbide as the thermal spray surface coating, selecting carbides of chromium, titanium or tungsten as the refractory metal carbide, selecting refractory metal borides as the thermal spray surface coating, and selecting refractory metal carbides and refractory metal borides as the thermal spray coating. The method further includes selecting refractory metal borides, carbides or nitrides as the diffusion alloy surface modification, selecting chromium boride or titanium boride, chromium carbide or titanium carbide, or chromium nitride as the diffusion alloy surface modification, selecting refractory metal carbides or nitrides as the diffusion alloy surface modification, and selecting chromium carbide, titanium carbide or chromium nitride as the diffusion alloy surface modification.

In a particularly preferred embodiment of the invention, there is provided the method of erosion protecting a steam turbine component having plural fluid directing surface regions spaced apart and differently subject to solid particle impacts at angles ranging from below 20 degrees to above 30 degrees to the component surface as a reference plane, including interposing a first surface protection relatively tougher and relatively less hard than a second surface protection and comprising a chromium carbide thermal spray surface coating containing from 8 to 12% by weight cobalt or nickel binder on component surface regions where solid particle impacts are at angles above 30 degrees to the component surface, and interposing a second surface protection relatively less tough and relatively harder than said first surface protection and comprising a titanium boride or chromium boride diffusion alloy surface modification on other component surface regions where solid particle impacts are at angles below 20 degrees to the component surface, whereby the component is differently protected in different surface regions thereof as a function of the angle of attack of solid particles.

The invention further contemplates a steam turbine component having plural fluid directing surfaces exposed to erosive particle impingements at different angles of attack ranging from below 20 degrees to above 30 degrees relative to the component surface, as a reference plane to the component surface, a first surface protection comprising a thermal spray surface mating on component surfaces subject to particle impingements at less than 20 degrees, and a second surface protection comprising a diffusion alloy surface modification on component surfaces subject to particle impingements at more than 30 degrees to the component surface, whereby differently particle-impinged surfaces of the component are differently protected.

In this and like embodiments, typically the thermal spray surface coating comprises a refractory metal carbide or horde, such as chromium carbide, titanium carbide or tungsten carbide, the thermal spray surface coating comprises a refractory metal boride, or the thermal spray surface coating comprises a refractory metal carbide and a refractory metal boride. Typically, too, the diffusion alloy surface modification comprises a refractory metal boride, carbide or nitride formed in situ in the component surface, such as a chromium boride or titanium boride, or refractory metal carbides or nitrides formed in situ in the component surface, such as chromium carbide or titanium carbide, or chromium nitride.

In a particularly preferred embodiment the invention provides a steam turbine component having plural fluid directing surface regions spaced apart and differently subject to solid particle impacts at angles ranging from below 20 degrees to above 30 degrees to the component surface, as a reference plane, a first surface protection comprising a chromium carbide thermal spray surface coating containing from 8 to 12% by weight cobalt or nickel binder, Cobalt Alloy 6 (AWS A5.13), titanium carbide, tungsten carbide, either with metal matrix, and mixtures of these carbides, and borides of these metals, including those having metal matrices, the first surface protection being deposited on component surface regions where solid particle impacts are at angles above 30 degrees to the component surface, and a second surface protection comprising a titanium boride, chromium boride, titanium carbide, chromium carbide, or chromium nitride diffusion alloy surface modification formed in situ in the surface on other surface regions where solid particle impacts are at angles below 20 degrees to the component surface, whereby the component is differently protected in different surface regions thereof as a function of the angle of attack of solid particles.

BRIEF DESCRIPTION OF THE DRAWINGS

The invention will be further described in conjunction with the attached drawings in which:

FIG. 1 is a perspective view of opposed nozzle and vane segments of a steam turbine;

FIG. 2 is a view in section of a nozzle partition according to the invention, its coatings being exaggerated for clarity of illustration;

FIG. 3 is a view in section of an impulse rotor blade differentially coated in accordance with the invention, the coatings being exaggerated for clarity of illustration; and, FIG. 4 is a view in section of a reaction rotor blade differentially coated in accordance with the invention, the coatings being exaggerated for clarity of illustration.

DESCRIPTION OF THE PREFERRED MODES

With reference now to the drawings, a steam turbine 10 has a nozzle partition or vane assembly 12 and a blade assembly 14. Assemblies 12 and 14 are juxtaposed such that fluid flows from the assembly of relatively fixed vanes 16, at angles determined by the vanes, to the blade assembly where the fluid impinges on the blades 18, causing the blade assembly; to rotate relative to the vane assembly.

The fluids typically entrain solid particles which, carried in the fluid, impinge against the vanes 16 and the blades 18 at different angles in different sections of the turbine. These angles of solid particle impacts range from the shallow angle, less than 20 degrees, to the much sharper angle, typically above 30 degrees with the vane or blade component surfaces constituting the reference plane. Effective protection of vanes and blades from erosive wear can be achieved by surface treatments of the vanes and blades, e.g. by application of coatings and surface modifications such as diffusion alloying to the vanes and blades. But only where the differences in performance characteristics of these surface treatments are taken into account is optimum erosion protection realized.

It has been discovered that the different angles of attack of erosive particles are effectively countered by using different surface treatments as a function of whether the attack angle of the erosive particles is less than 20 degrees to the surface or above 30 degrees to the component surface. In the 20–30 degree range either of the herein discussed surface treatments can be used with more or less effectiveness. In determining which surface treatment to use consideration is given to the angle of attack and to the need for a relatively harder and less tough or a relatively tougher and less hard surface treatment, Diffusion alloy coatings or surface modifications tend to be harder but less malleable, less yielding to impacts, and therefore less tough. On the other hand, thermal spray coatings tend to be not as hard as diffusion alloys but more malleable, and more yielding to impacts such that these two types of surface treatments vary in their response to different use conditions including different angles of impact of erosive particulate. In general, harder surface treatments are more effective in preventing erosion where the angle of particle impact is less than 20 degrees to the component surface. Conversely, tougher surface treatments are more effective in preventing erosion where the angle of attack is greater than 30 degrees to the component surface.

It is thus advantageous to analyze the use condition of each vane and blade in a steam turbine for the anticipated angle to the component surface of particle attack and to tailor the surface treatment of the particular blade or vane. This is illustrated in FIGS. 2–4 of the drawing. In FIG. 2, for example, the nozzle partition 30 shown will have a high angle particle attack erosion zone on its surface at 32 when the vane is used in a steam turbine reheat stage and the partition is thus provided with a tough coating of thermal spray material in this zone where particle impacts at angles in excess of 30 degrees to the component surface are anticipated. The harder diffusion alloy coating systems are not as effective in the zone 32. Where the partition 30 is used in steam turbine control stage the erosion zone will likely be zone 34, with the particle impacts being at an angle of less than 20 degrees to the partition surface. For the zone 34 then the appropriate surface treatment is diffusion alloy, a hard coating, for the less hard, albeit tougher, thermal spray coating is not as effective against erosive wear as the diffusion alloy with the low angle impacts anticipated in this zone.

In FIG. 3, impulse rotor blade 40 has a low angle impact zone 42 where the diffusion alloy is effectively used, and a high angle impact zone 44 where a thermal spray coating is effective.

In FIG. 4, reaction rotor blade 50 has a high angle impact zone 52, treated with a thermal spray coating, with the remainder of the blade effectively treated as a low angle impact zone 54 and diffusion alloyed.

The specific diffusion alloys and thermal spray materials used in the invention are not narrowly critical and can be any of the diffusion alloys and thermal sprays previously used or suggested for steam turbine surface treatments or other like materials. Application of these materials is conventional and need not be detailed here. In general, the vane or other part can be masked off so as to limit the area of diffusion alloying to a selected zone, and then thermal sprayed in the selected zones for the tougher coating. Any other suitable method of applying both hard coatings and tough coatings to different regions of a vane or blade (partition) can be used, as well.

The invention thus provides turbine vane and blade components with improved erosion wear resistance over the entire component, and further, coatings on turbine components tailored to the application and to the wear conditions expected, generally as a function of angle of attack of the erosive stream, which attack angle is determined by the type and configuration of the component, and its placement in the turbine. The invention further varies the coating on a single component by both placement and composition to more effectively counter different wear conditions, so that, e.g.

control and reheat stage rotor blades and vanes show dramatic improvements in wear performance as the coating type is tailored to the wear type in a single component, taking into account the component location in the turbine, with harder coatings used on certain surfaces of control stage nozzles and rotor blades, and tougher coatings on other surfaces thereof. Tougher thermal spray coatings are used on certain surface regions where they are most effective, such as where the erosive stream of solid particles attacks the surface region at an angle of 30 degrees or more, and harder diffusion alloy coatings, or surface modifications, are used where the stream of erosive solid particles attacks the surface region at an angle of 20 degrees or less The foregoing objects of the invention are thus met.

We claim:

1. Method of erosion-protecting a steam turbine component having plural fluid directing surface regions spaced apart and differently subject to solid particle impacts at angles ranging from below 20 degrees to above 30 degrees to the component surface as a reference plane, including interposing a first surface protection comprising a thermal spray surface coating on component surface regions where solid particle impacts are at angles above 30 degrees to the component surface, and interposing a second surface protection comprising a diffusion alloy surface modification on other component surface regions where solid particle impacts are at angles below 20 degrees to the component surface, whereby said component is differently protected in different surface regions thereof as a function of the angle of attack of solid particles.

2. The method according to claim 1, including spraying a refractory metal carbide as said thermal spray surface coating.

3. The method according to claim 2, including also selecting carbides or borides of chromium, titanium or tungsten as said refractory metal carbide.

4. The method according to claim 1, including also selecting refractory metal borides as said thermal spray surface coating.

5. The method according to claim 1, including also selecting refractory metal carbides and refractory metal borides as said thermal spray coating.

6. The method according to claim 1, including selecting refractory metal borides, carbides or nitrides as said diffusion alloy surface modification.

7. The method according to claim 6, including also selecting chromium boride or titanium boride, chromium carbide or titanium carbide, or chromium nitride as said diffusion alloy surface modification.

8. The method according to claim 1, including selecting refractory metal carbides or nitrides as said diffusion alloy surface modification.

9. The method according to claim 8, including also selecting chromium carbide, titanium carbide or chromium nitride as said diffusion alloy surface modification.

10. Method of erosion protecting a steam turbine component having plural fluid directing surface regions spaced apart and differently subject to solid particle impacts at angles ranging from below 20 degrees to above 30 degrees to the component surface as a reference plane, including interposing a first surface protection relatively less hard and relatively tougher than a second surface protection and comprising a chromium carbide thermal spray surface coating containing from 8 to 12% by weight cobalt or nickel binder on component surface regions where solid particle impacts are at angles above 30 degrees to the component surface, and interposing a second surface protection relatively less tough and relatively harder than said first surface protection and comprising a titanium boride or chromium boride diffusion alloy surface modification on other component surface regions where solid particle impacts are at angles below 20 degrees to the component surface, whereby said component is differently protected in different surface regions thereof as a function of the angle of attack of solid particles.

11. Steam turbine component having plural fluid directing surfaces exposed to erosive particle impingements at different angles of attack ranging from below 20 degrees to above 30 degrees relative to the component surface as a reference plane, a first surface protection comprising a thermal spray surface coating on component surfaces subject to particle impingements at less than 20 degrees to the component surface, and a second surface protection comprising a hard diffusion alloy surface modification on component surfaces subject to particle impingements at more than 30 degrees to the component surface, whereby differently particle-impinged surfaces of said component are differently protected.

12. The steam turbine component according to claim 11, in which said thermal spray surface coating comprises a refractory metal carbide or boride.

13. The steam turbine component according to claim 12, in which said refractory metal carbide comprises chromium carbide, titanium carbide or tungsten carbide.

14. The steam turbine component according to claim 11, in which said thermal spray surface coating comprises a refractory metal boride.

15. The steam turbine component according to claim 11, in which said thermal spray surface coating comprises a refractory metal carbide and a refractory metal boride.

16. The steam turbine component according to claim 11, in which said diffusion alloy surface modification comprises a refractory metal boride, carbide or nitride formed in situ in said component surface.

17. The steam turbine component according to claim 16, in which said refractory metal boride comprises chromium boride or titanium boride.

18. The steam turbine component according to claim 11, in which said diffusion alloy surface modification comprises including selecting refractory metal carbides or nitrides formed in situ in said component surface.

19. The steam turbine component according to claim 18, in which said refractory metal carbides comprise chromium carbide or titanium carbide.

20. The steam turbine component according to claim 18, in which said refractory metal nitride comprises chromium nitride.

21. Steam turbine component having plural fluid directing surface regions spaced apart and differently subject to solid particle impacts at angles ranging from below 20 degrees to above 30 degrees to the component surface as a reference plane, a first surface protection comprising a chromium carbide thermal spray surface coating containing from 8 to 12% by weight cobalt or nickel binder, said first surface protection being deposited on component surface regions where solid particle impacts are at angles above 30 degrees to the component surface, and a second surface protection comprising a titanium boride or chromium boride diffusion alloy surface modification formed in situ in said surface on other surface regions where solid particle impacts are at angles below 20 degrees to the reference surface, whereby said component is differently protected in different surface regions thereof as a function of the angle of attack of solid particles.

* * * * *